US007143675B2

(12) United States Patent
Chiang

(10) Patent No.: US 7,143,675 B2
(45) Date of Patent: Dec. 5, 2006

(54) PUNCHER HAVING A DOUBLE CUTTER LINKAGE STRUCTURE

(76) Inventor: Tung-Lung Chiang, No. 20, Min Sheng Rd., Tou Liu City, Yu Lin Hsien (TW)

( * ) Notice: Subject to any disclaimer, the term of this patent is extended or adjusted under 35 U.S.C. 154(b) by 0 days.

(21) Appl. No.: 11/052,826

(22) Filed: Feb. 9, 2005

(65) Prior Publication Data

US 2006/0174741 A1 Aug. 10, 2006

(51) Int. Cl.
*B26D 5/08* (2006.01)
*B26F 1/02* (2006.01)

(52) U.S. Cl. ..... 83/193; 83/146; 83/618; 83/632; 83/633; 83/687

(58) Field of Classification Search ..... 83/615, 83/618, 54, 145, 146, 188, 192–194, 513, 83/516, 517, 519, 627, 632–634, 687; 412/9, 412/16, 22, 33, 40
See application file for complete search history.

(56) References Cited

U.S. PATENT DOCUMENTS 466,823 A * 1/1892 Gendron ..... 83/135
1,164,027 A * 12/1915 Stevenson ..... 83/572
1,503,551 A * 8/1924 Nice ..... 83/181
1,595,678 A * 8/1926 Murphy ..... 83/194
1,758,192 A * 5/1930 Grubman ..... 83/193
2,315,340 A * 3/1943 Knudsen ..... 83/185
2,423,791 A * 7/1947 Nelson ..... 83/144
2,695,061 A * 11/1954 Laxo ..... 83/513
3,491,639 A * 1/1970 Hale et al. ..... 83/179
3,709,082 A * 1/1973 Leska ..... 83/618
4,098,161 A * 7/1978 Bloch ..... 83/519
RE33,798 E * 1/1992 Waltonen ..... 83/529
5,699,708 A * 12/1997 Deni et al. ..... 83/180
5,896,796 A * 4/1999 Chih ..... 83/181
6,186,720 B1 * 2/2001 Chiang ..... 412/16

* cited by examiner

*Primary Examiner*—Clark F. Dexter
(74) *Attorney, Agent, or Firm*—Rosenberg, Klein & Lee

(57) ABSTRACT

A puncher having a double cutter linkage structure includes a driving shaft, a driving plate, a front linking rod, a rear linking rod, a front cutter seat, a rear cutter seat, a front cutter, a rear cutter, and a positioning seat. The driving plate is fixed to the driving shaft which has two ends connected to one end of the front linking rod and one end of the rear linking rod, respectively. The front linking rod is pivotally connected to the front cutter seat which is fixed to the front cutter. The rear linking rod has an curved arm at the other end to be connected to the rear cutter seat which is fixed to the rear cutter. The positioning seat is in a reverse U shape and has a front plate and a rear plate at respective sides.

2 Claims, 3 Drawing Sheets

PUNCHER HAVING A DOUBLE CUTTER LINKAGE STRUCTURE

BACKGROUND OF THE INVENTION

1. Field of the Description

This invention relates to a puncher, and more particularly to a puncher with front and rear cutters linked to move simultaneously to punch holes in different sizes at the same time.

2. Description of the Prior Art

A conventional paper puncher, as shown in FIG. 3 comprises a driving shaft A, a driving plate B, a sliding block C, a front cutter D, a rear cutter E, a front positioning board F and a rear positioning board G. The driving plate B is linked by the driving shaft A. The bottom end of the driving plate B is connected to a spring B1. The top end of the driving plate B has a fork arm B2 to receive an idle gear C1 therein. The sliding block C is fixed to a front fixing plate D1 of the front cutter D and a rear fixing plate E1 of the rear cutter E. A front cutter hole F1 and a rear cutter through hole F2 are formed on the front positioning board F. A rear cutter hole G1 is formed on the rear positioning board G.

The driving shaft A links the driving plate B to bring the idle gear C1 to move forward, which links the sliding block C to move simultaneously. Thus the front cutter D slides through the front cutter hole F1 of the front positioning board F. The rear cutter E slides through the rear cutter through hole F2 of the front positioning board F and the rear cutter hole G1 of the rear positioning board G to punch holes.

The front and rear cutters of this design are placed too close to each other, which makes the installation complicated. The longer body of the rear cutter requires more material, and may be shaken in the punching process to punch holes not in a precise alignment.

SUMMARY OF THE INVENTION

It is the primary objective of the present invention to provide a puncher having a double cutter linkage structure, which is easy to install and to operate.

It is another objective of the present invention to provide a puncher having a double cutter linkage structure, which cutters are secured firmly in the puncher and punch holes in a precise alignment.

It is a further objective of the present invention to provide a puncher having a double cutter linkage structure, which is cost effective to manufacture.

DETAILED DESCRIPTION OF THE PREFERRED EMBODIMENT

Figure 1:
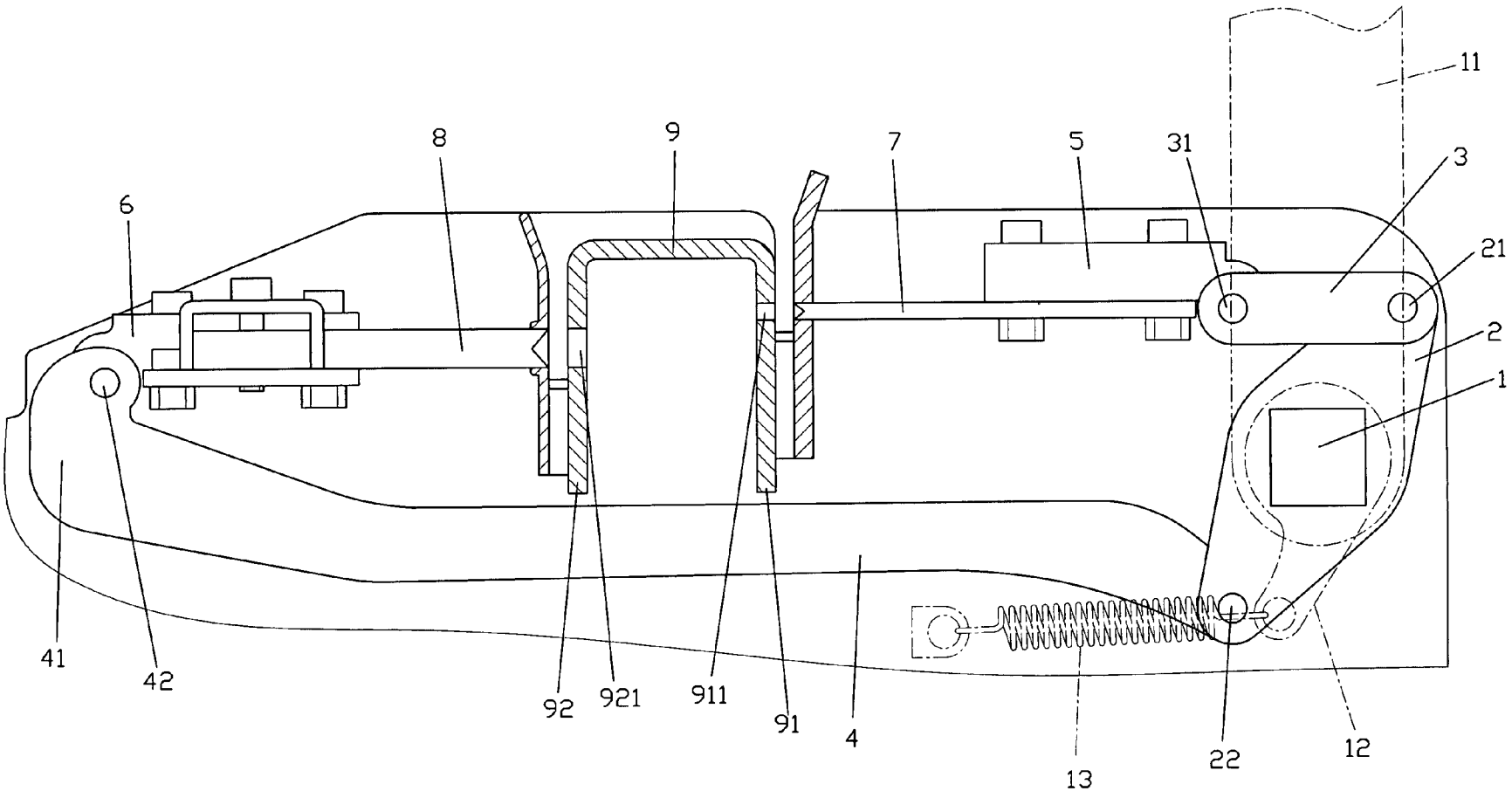
FIG. 1 is a side view of the present invention, partially sectioned.

As shown in FIG. 1, the present invention comprises a driving shaft 1, a driving plate 2, a front linking rod 3, a rear linking rod 4, a front cutter seat 5, a rear cutter seat 6, a front cutter 7, a rear cutter 8, and a positioning seat 9.

The driving shaft 1 is connected to a handle 11 for a user to hold and operate the puncher and to an extension plate 12 that is connected with one end of a spring 13. The spring 13 has the other end secured to the case of the puncher. The driving plate 2 is fixed to the driving shaft 1 with a pair of pivoting pins 21 and 22 set at respective ends thereof. One end of the driving plate 2 is pivotally connected to one end of the front linking rod 3 with the pivoting pin 21. The front linking rod 3 has the other end connected to the front cutter seat 5 with a pivoting pin 31. The front cutter seat 5 is fixed to the front cutter 7. The other end of the driving plate 2 is pivotally connected to one end of the rear linking rod 4 with the pivoting pin 22. The rear linking rod 4 has a curved arm 41 at the other end to connect to one end of the rear cutter seat 6 with a pivoting pin 42. The rear cutter seat 6 is fixed to the rear cutter 8. The positioning seat 9 is in a reverse U shape and has a front plate 91 at one side and a rear plate 92 at the other side. The front plate 91 of the positioning seat 9 has a through hole 911 for the front cutter 7 to extend there through. The rear plate 92 also has a through hole 921 for the rear cutter 8 to extend there through.

Figure 2:
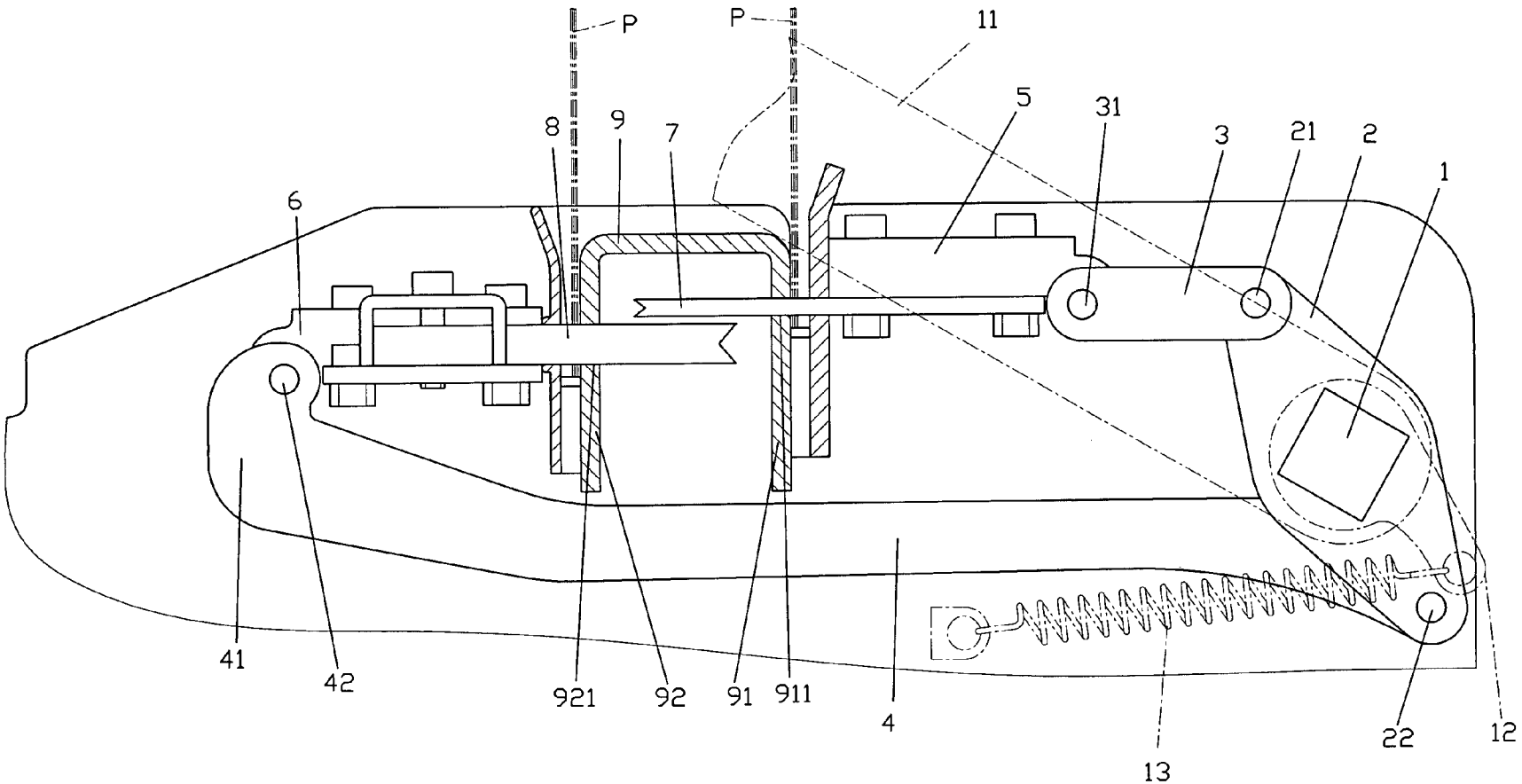
FIG. 2 is a view similar to FIG. 1 showing an operation of the present invention.
Figure 3:
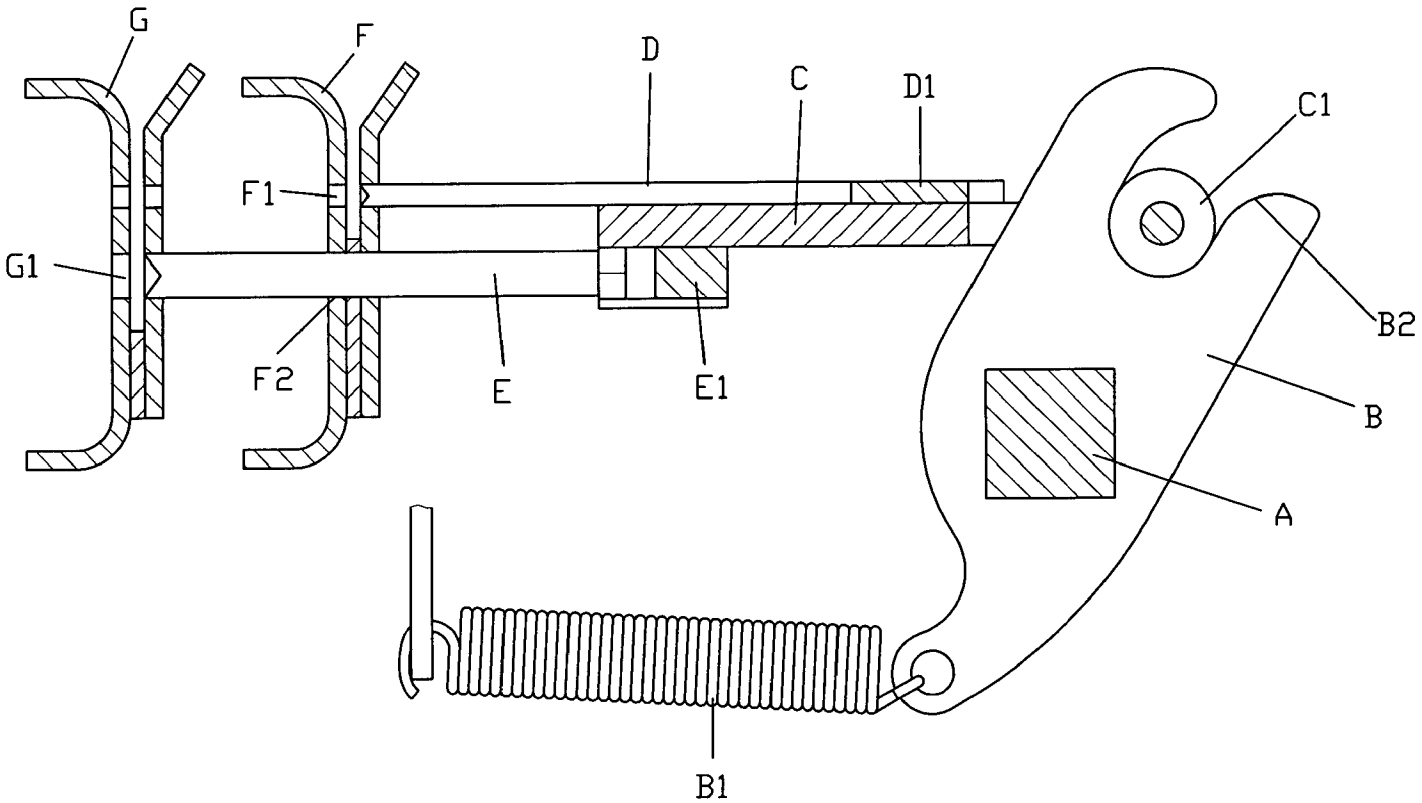
FIG. 3 (PRIOR ART)
FIG. 3 is a side view of a prior art puncher in an operating status.

To operate the present invention, as shown in FIG. 2, the handle 11 is pulled to link the driving shaft 1 and the extension plate 12 to move simultaneously, which then link the front linking rod 3, the rear linking rod 4, the front cutter seat 5, the rear cutter seat 6, the front cutter 7 and the rear cutter 8 to move toward the positioning seat 9, while the front cutter 7 and the rear cutter 8 will extend through the through hole 911 of the front plate 91 and the through hole 921 of the rear plate 92 to punch paper P at the same time in different sizes.

Practically, the rear linking rod 4 is longer in length, in accordance with the physics theory, the longer it is, the less strength it will require. Thus the rear cutter 8 is in a stable status and more accurate. Both the front cutter 7 and the rear cutter 8 are located on respective sides of the positioning seat 9 so the installation is easier. The reverse U-shaped configuration of the positioning seat 9 provides a stronger strength and stability.

What is claimed is:

1. A puncher having a double cutter linkage structure comprising:

a rotatable driving shaft;

a driving plate having an intermediate portion affixed to said driving shaft for rotation therewith, said driving plate having a pair of end portions extending from said intermediate portion;

a front linking rod having a first end pivotally coupled to a first of said pair of end portions of said driving plate for substantially linear displacement thereof responsive to rotative displacement of said driving plate and a second end displaced from said first end by a first distance;

a rear linking rod having a first end pivotally coupled to a second of said pair of end portions of said driving plate for substantially linear displacement thereof responsive to rotative displacement of said driving plate, said rear linking rod having a second end displaced from said first end by a second distance, said second distance being greater than said first distance, said second end of said rear linking rod being curved to face said first end thereof;

a front cutter seat pivotally coupled to said second end of said front linking rod for linear displacement therewith;

a rear cutter seat pivotally coupled to said second end of said rear linking rod for linear displacement therewith;

a front cutter affixed to said front cutter seat for displacement therewith and extending in a first direction;

a rear cutter affixed to said rear cutter seat for displacement therewith and extending in a second direction, said second direction being opposite to said first direction; and a positioning seat disposed between said front cutter and said rear cutter, said positioning seat having a front plate and a rear plate, said front plate having a through hole for said front cutter to extend therethrough and said rear plate having a through hole for said rear cutter to extend therethrough, wherein said front cutter and said rear cutter are simultaneously displaced through a respective one of said through holes of said front plate and said rear plate responsive to rotation of said driving shaft.

2. The puncher having a double cutter linkage structure, as recited in claim 1, wherein said positioning seat is in a reverse U shape to form said front and rear plates at respective sides.

* * * * *